US010625333B2

(12) United States Patent
Edwards, II et al.

(10) Patent No.: US 10,625,333 B2
(45) Date of Patent: Apr. 21, 2020

(54) FASTENING APPARATUS FOR APPLYING SELF PIERCING RIVETS

(71) Applicant: Honda Motor Co., Ltd., Tokyo (JP)

(72) Inventors: Paul Carlos Edwards, II, Marysville, OH (US); Richard Wolfgang Geary, Hilliard, OH (US); Matthew J. Raiche, Powell, OH (US); Kevin Scott Schnipke, Prospect, OH (US); Gregory A. Seckel, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 56 days.

(21) Appl. No.: 15/955,350

(22) Filed: Apr. 17, 2018

(65) Prior Publication Data

US 2019/0314887 A1 Oct. 17, 2019

(51) Int. Cl.

| | |
|---|---|
| ***B21J 15/36*** | (2006.01) |
| ***B21J 15/02*** | (2006.01) |
| ***B21J 13/02*** | (2006.01) |

(52) U.S. Cl.

CPC ..... *B21J 15/025* (2013.01); *B21J 13/02* (2013.01); *B21J 15/36* (2013.01)

(58) Field of Classification Search

CPC ..... B21J 15/025; B21J 15/36; B21J 13/02

See application file for complete search history.

(56) References Cited

U.S. PATENT DOCUMENTS

| | | | | |
|---|---|---|---|---|
| 6,883,223 | B2 * | 4/2005 | Edwards | B21J 15/025 29/428 |
| 7,140,813 | B2 | 11/2006 | Tucker | |
| 7,596,858 | B2 * | 10/2009 | Opper | B21J 15/025 29/716 |
| 9,339,899 | B2 * | 5/2016 | Doo | B21J 15/025 |
| 9,387,557 | B2 | 7/2016 | Doo et al. | |

FOREIGN PATENT DOCUMENTS

| | | |
|---|---|---|
| CN | 104493049 | 8/2015 |
| JP | 3742297 | 7/2002 |

* cited by examiner

*Primary Examiner* — Rick K Chang

(74) *Attorney, Agent, or Firm* — Rankin, Hill & Clark LLP

(57) ABSTRACT

A fastening apparatus for setting a fastener penetrating into a workpiece having a first and a second sheet of material to be joined is provided. The fastening apparatus includes a frame supporting a punch and an upsetting die assembly. The upsetting die assembly includes a housing defining an axial bore, and a die member and a rod located in the bore. The die member and rod are axially displaceable within the bore. A stop member is pivotally connected to the frame and is in engagement with the rod. A fastener insertion force generated by the punch displaces the die member and rod within the bore, and the stop member is configured to dampen the axial displacement and reduce the fastener insertion force over a predetermined fastener insertion distance of the fastener into the workpiece.

15 Claims, 7 Drawing Sheets

FASTENING APPARATUS FOR APPLYING SELF PIERCING RIVETS

BACKGROUND

A known fastening apparatus for applying a self-piercing rivet include a nose assembly into which the rivet is passed from a rivet storage location, and from which the rivet is inserted into a workpiece by a punch. The fastening apparatus includes an upsetting die which is located beneath the workpiece and which is configured to upset the rivet when the rivet is inserted into the workpiece. Typically the volume and shape of the upsetting die is chosen to provide a desired degree of upsetting such that the rivet adopts a desired shape when it is inserted into the workpiece. However, for a workpiece having a lower sheet of formed of a cast material, high concentrated stress on the lower sheet during fastening can result in the lower sheet cracking.

BRIEF DESCRIPTION

According to one aspect, a fastening apparatus for setting a fastener penetrating into a workpiece having a first and a second sheet of material to be joined is provided. The fastening apparatus comprises a frame supporting a punch and an upsetting die assembly. The upsetting die assembly includes a housing defining an axial bore, and a die member and a rod located in the bore. The die member and rod are axially displaceable within the bore. A stop member is pivotally connected to the frame and is in engagement with the rod. A fastener insertion force generated by the punch displaces the die member and rod within the bore, and the stop member is configured to dampen the axial displacement and reduce the fastener insertion force over a predetermined fastener insertion distance of the fastener into the workpiece.

According to another aspect, a fastening method comprises using a punch to push a fastener into a workpiece having a first and a second sheet of material to be joined; using an upsetting die assembly to upset the fastener, wherein the upsetting die assembly includes a housing defining an axial bore, and a die member and a rod located in the bore, wherein the die member and rod are axially displaceable within the bore, and a fastener insertion force generated by the punch displaces the die member and rod within the bore; and using a dampening force member preset with a predetermined dampening force to dampen the axial displacement as the fastener penetrates into the workpiece.

According to another aspect, a fastening apparatus for setting a fastener penetrating into a workpiece having a first and a second sheet of material to be joined is provided. The fastening apparatus comprises a frame supporting a punch and an upsetting die assembly. The upsetting die assembly includes a housing defining an axial bore, and a die member and a rod located in the bore. An end portion of the rod projects from a lower end of the housing. The die member and rod are axially displaceable within the bore. A dampening force member is mounted to the frame. A stop member is pivotally connected to the frame beneath the upsetting die assembly. The stop member is in the form of a lever having a first end portion in engagement with the end portion of the rod and a second end portion in engagement with the dampening force member. A fastener insertion force generated by the punch displaces the die member and rod within the bore. The stop member is configured to apply a dampening force generated from the dampening force member to the end portion of the rod to dampen the axial displacement and decrease the fastener insertion force over a predetermined fastener insertion distance which is a distance from an initial piercing to rivet completion of the workpiece by the self-piercing rivet.

DETAILED DESCRIPTION

It should, of course, be understood that the description and drawings herein are merely illustrative and that various modifications and changes can be made in the structures disclosed without departing from the present disclosure. Spatially relative terms such as upper and lower may be used to describe an element and/or feature's relationship to another element(s) and/or feature(s) as, for example, illustrated in the figures. These terms are used merely to facilitate description of the embodiments and are not intended to imply that the exemplary fastening apparatus or any components of the fastening apparatus must have a particular orientation.

Figure 1:
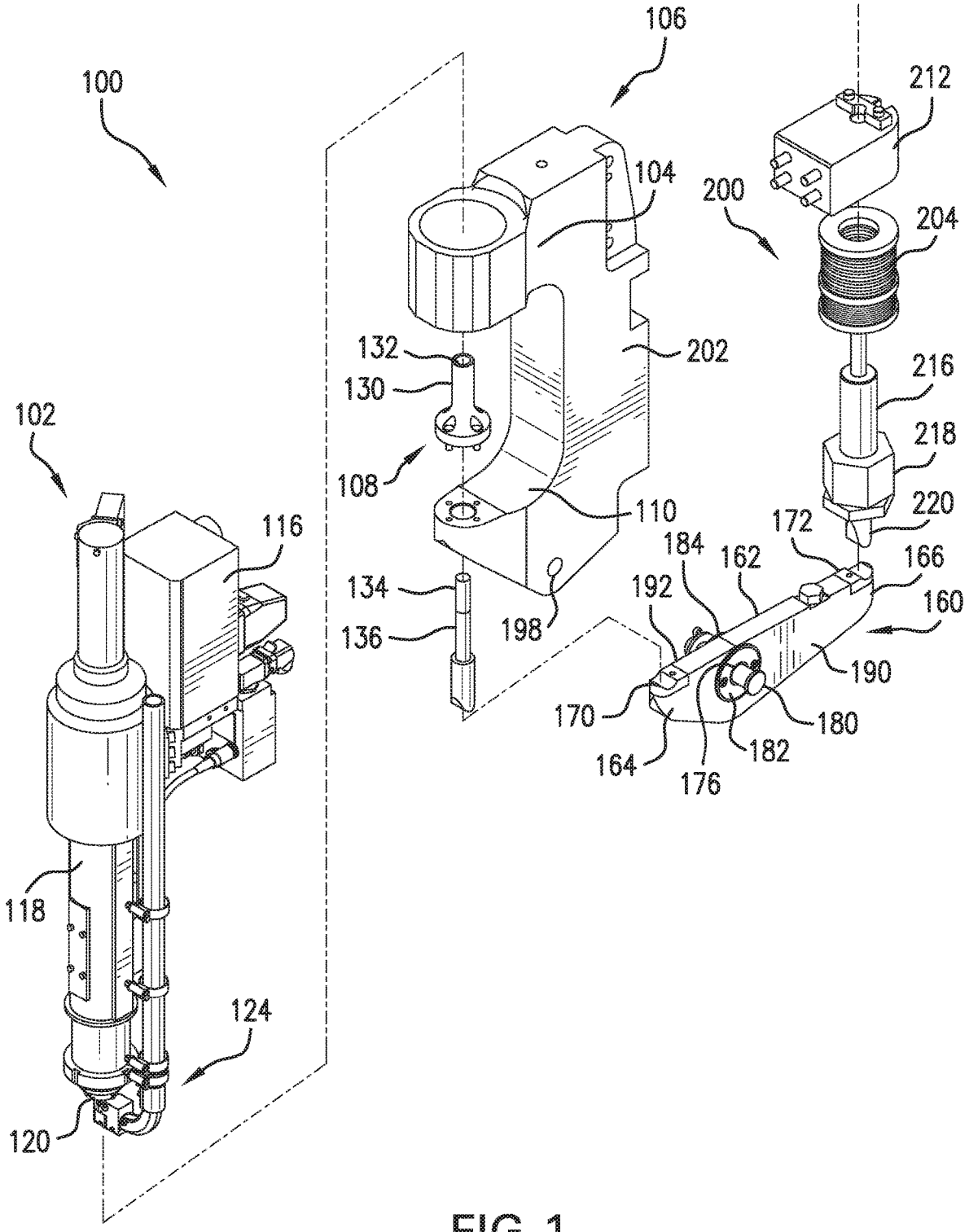
FIG. 1 is a partial exploded perspective view of a fastening apparatus according to one aspect of the present disclosure.
Figure 7B:
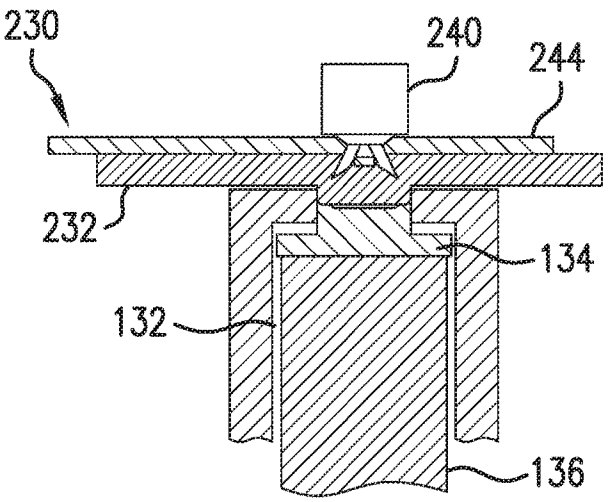
FIGS. 7(A) and 7(B) schematically depict a fastening process according to the present disclosure FIG. 8 graphically illustrates rivet insertion force and lower die member force compared to rivet insertion distance during the exemplary fastening process.
Figure 7A:
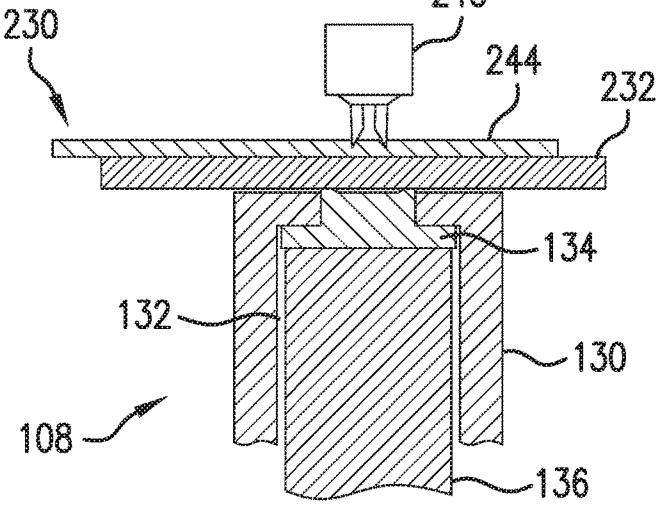

Referring now to the drawings, wherein like numerals refer to like parts throughout the several views, FIG. 1 illustrates a fastening apparatus 100 according to an embodiment of the present disclosure for setting a fastener (for example, a self-piercing rivet) penetrating into a workpiece having at least a first and a second sheet of material to be joined (for example, see workpiece 230 having first and second sheets 244, 232 in FIGS. 7(A) and 7(B)). The fastening apparatus 100 comprises a rivet setting tool 102 that is supported by an upper jaw or arm 104 of a generally C-shaped frame 106 above an upsetting die assembly 108 disposed on a lower jaw or arm 110 of the frame. Rivets are inserted by the setting tool 102 into the workpiece supported over the upsetting die assembly 108 as is well known in the art.

The setting tool 102 generally comprises an electric drive 116 (other types of drive such as hydraulic or pneumatic can be used) that operates to drive a reciprocal punch (hidden in FIG. 1) in a cylindrical housing 118 and a nose assembly 120. The reciprocal punch is used to insert rivets into the workpiece. The rivets are supplied under air or gas pressure from a bulk feeder (not shown) via a delivery tube (not shown). Supplied rivets pass through the delivery tube to a feeder assembly 124 that is mounted to the setting tool 102. The rivets are then transferred from the feeder assembly 124 into the nose assembly 120 from where they are inserted into the workpiece. When rivets are inserted into the workpiece they are upset by the upsetting die assembly 108.

As is well known, a fastening delivery system may comprise the fastening apparatus 100 described above, and may further comprise a rivet feeding system and a control system. The rivet feeding system is configured to deliver rivets via a connector of the fastening apparatus 100 to the delivery tube. The control system is configured to control delivery of rivets to the nose assembly 120, and is configured to control operation of the reciprocal punch.

Figure 2:
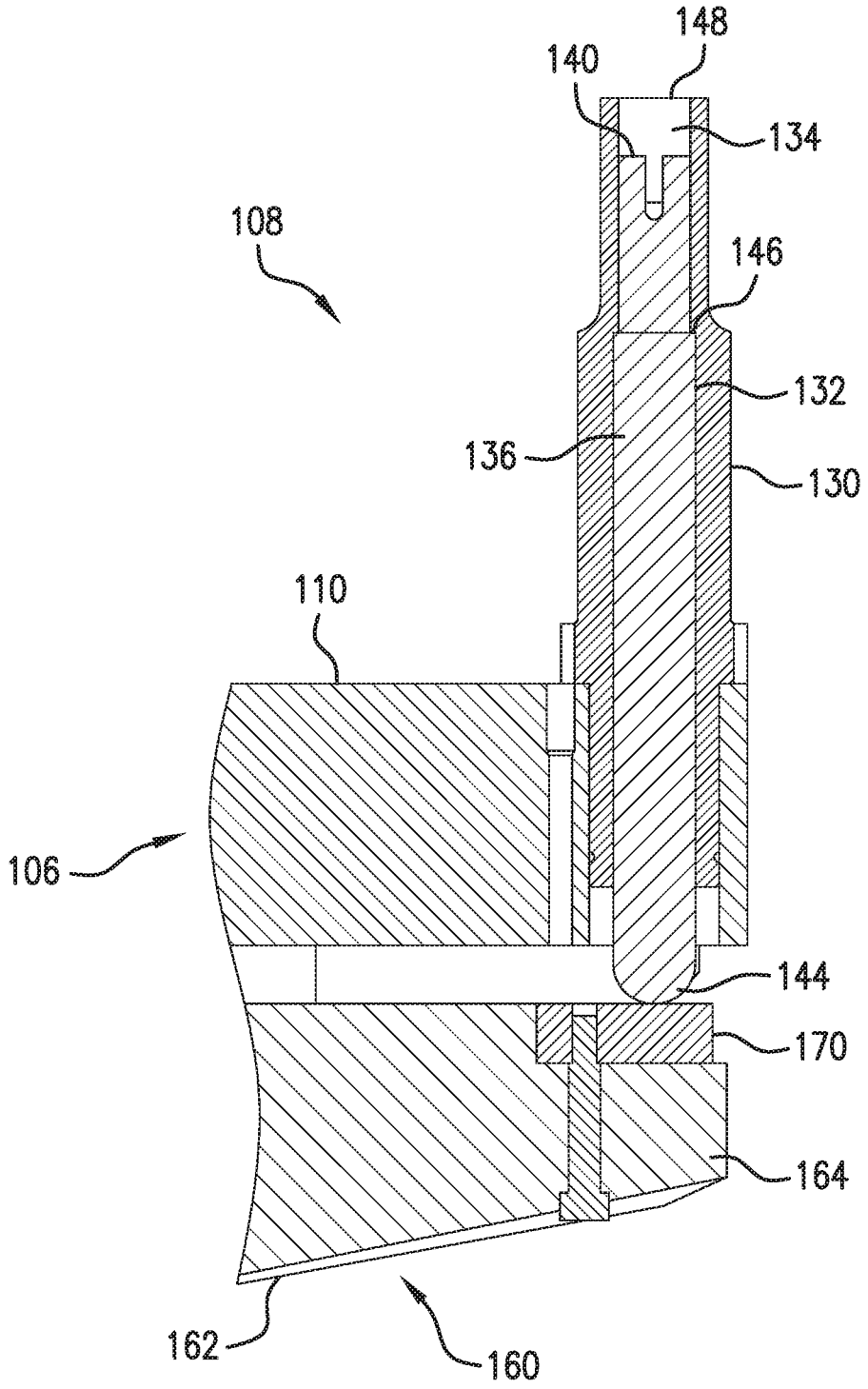
FIG. 2 shows an upsetting die assembly of the fastening apparatus in cross-section according to an embodiment of the present disclosure.
Figure 3:
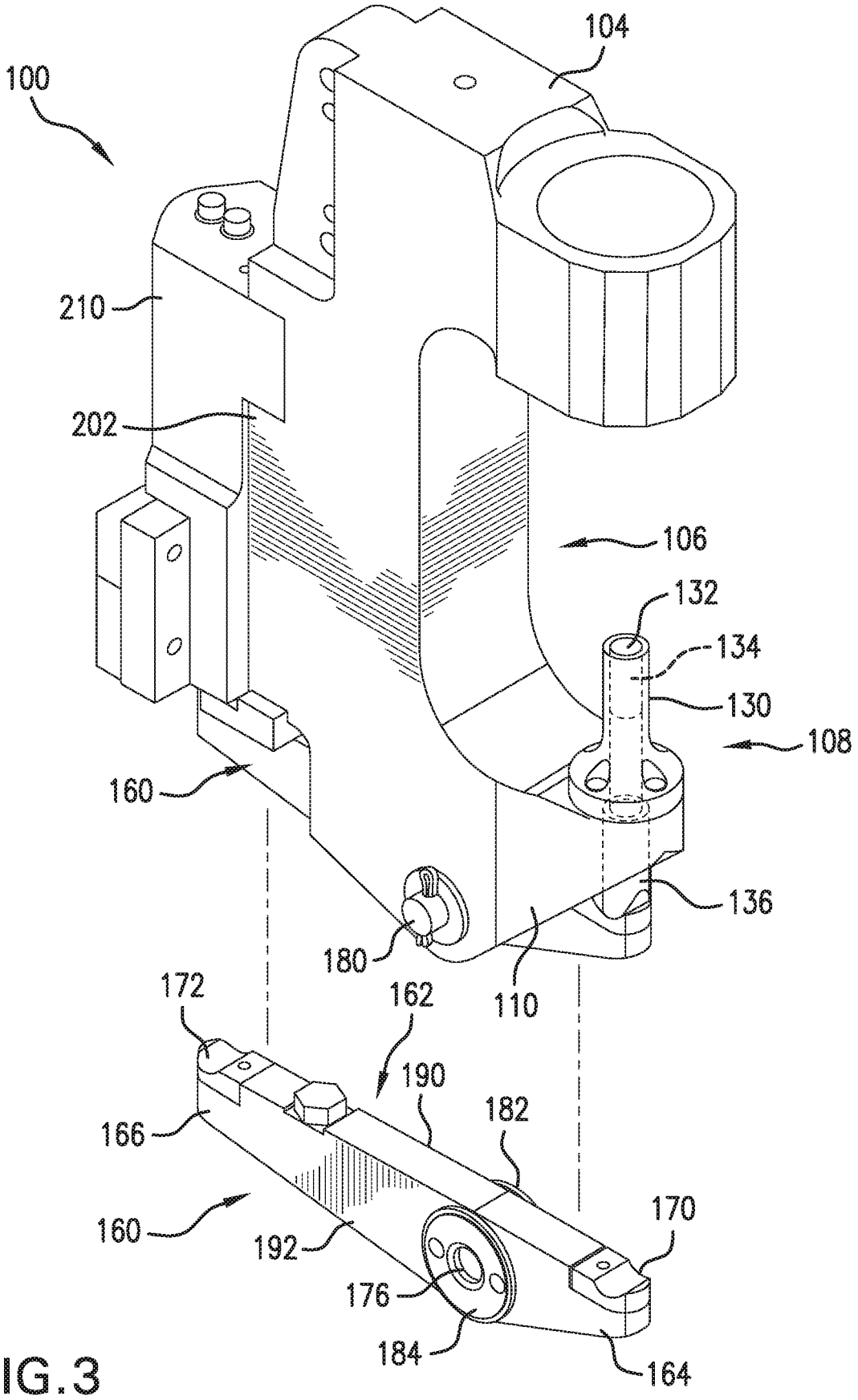
FIG. 3 is a perspective view of the fastening apparatus of FIG. 1, with a stop member of the fastening apparatus both assembled to and separated from a frame of the fastening apparatus.

FIG. 2 shows an upsetting die assembly 108 in cross-section according to an embodiment of the present disclosure. The upsetting die assembly 108 comprises a housing 130 within which an axial bore 132 is provided. The housing 130 is mounted to the lower arm 110 of the frame 106. A die member 134 and a rod 136 are located within the bore 132, and are axially displaceable within the bore 132. The rod 136 is provided at an upper end with a substantially flat upper surface 140 adapted to mount the die member 134. Each of the die member 134 and the rod 136 has a diameter which substantially corresponds with a diameter of the bore 132 such that the die member 134 and the rod 136 do not move laterally within the bore (although a small degree of lateral movement may arise from tolerances in the size of the die member 134, the rod 136, and the bore 132 during their manufacture). A lowermost end 144 of the rod 136 can be curved; although, this is not required. A step 146 located in the bore 132 defines a hard stop for the insertion of the rod 136 having the die member 134 mounted thereto into the bore 132, the hard stop ensuring that an upper surface 148 of the die member 134 does not protrude outwardly from the housing 130.

The lowermost end 144 of the rod 136 abuts against a stop member 160, which prevents the rod from falling out of the bore 132. When a fastener is being inserted into a workpiece, the stop member 160 at least partially restricts axial movement of the rod 136, and in turn, the die member 134 within the bore 132. In the depicted embodiment of FIG. 1, the stop member 160 is pivotally connected to the frame 106 so as to be in engagement with the rod 136. Particularly, the stop member 160 is in the form of a lever 162 pivotally connected to the lower arm 110 of the frame 106. The lever 162 includes a first end portion 164 and a second end portion 166 spaced from the first end portion along a length direction of the lever 162. Each of the first and second end portions 164, 166 can have mounted thereto a respective wear pad 170, 172. A through-hole 176 extends in a width direction of the lever 162 and is sized to receive a pivot pin 180. Low friction washers 182, 184 for the pivot pin 180 can be mounted to respective sidewalls 190, 192 of the lever 162. The frame 106 includes a channel 196 (see FIGS. 4 and 5) for receiving the lever 162, with the lower arm 110 including a through-hole 198 for the pivot pin 180. Therefore, the stop member 160 is located beneath a lower arm 110 and extends along a length direction of the lower arm, and the lowermost end 144 of the rod 136 extends outwardly from the upsetting die housing 130 for engagement with the stop member 160.

Figure 4:
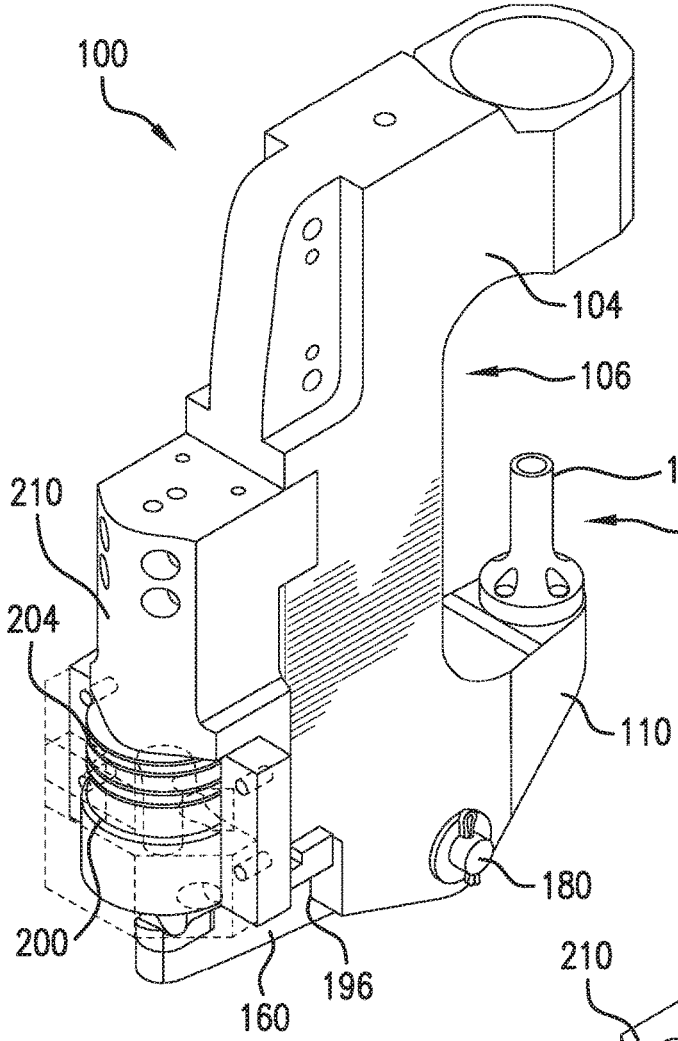
FIG. 4 is another perspective view of the fastening apparatus of FIG. 1.

Further depicted in FIGS. 1 and 4, a dampening force member 200 is mounted to a base 202 of the frame 106 which extends between the upper and lower arms 104, 110. The lever 162 has its fulcrum (defined by the pivot pin 180) located between the upsetting die assembly 108 and the dampening force member 200, wherein the first end portion 164 of the lever 162 is in engagement with the lowermost end 144 of the rod 136 and the second end portion 166 of the lever 162 is in engagement with the dampening force member 200. According to the present disclosure, the dampening force member 200 is preset or preloaded with a predetermined dampening force (for example, a predetermined range of dampening force) to be applied to the stop member 160 regardless of fastener type and material type of the first and second sheets of the workpiece.

Figure 5:
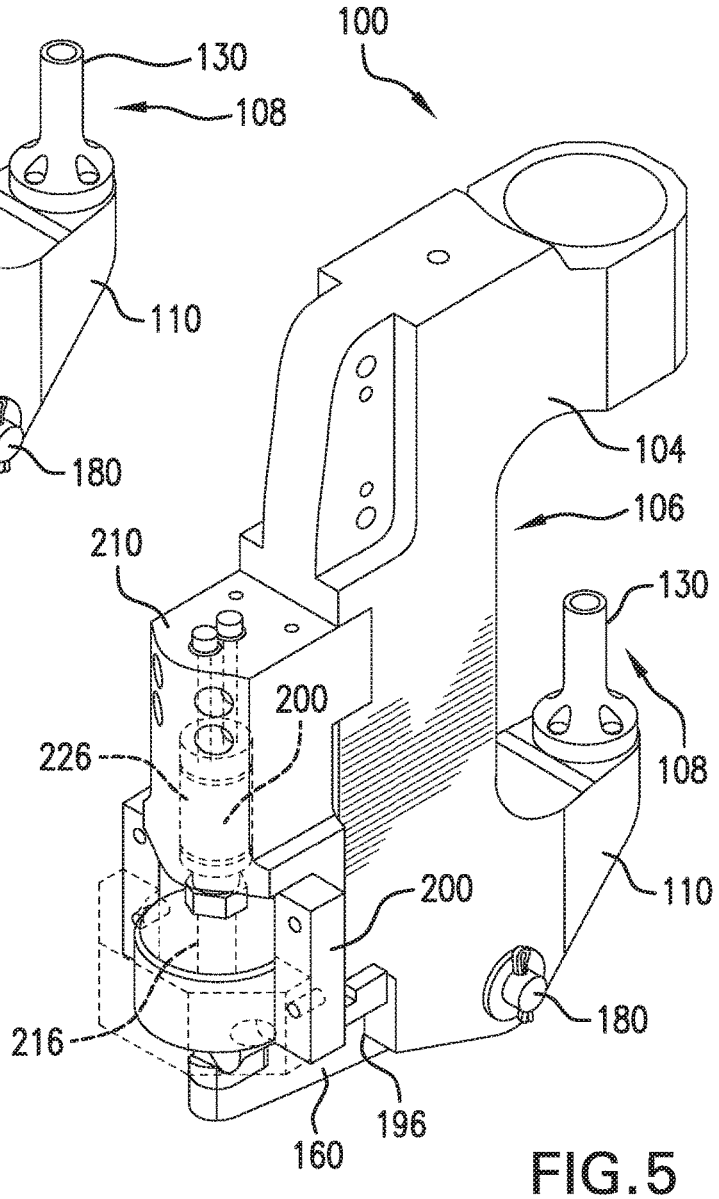
FIG. 5 is a perspective view of a fastening apparatus according to another aspect of the present disclosure.

According to one aspect, as shown in FIGS. 1 and 4, the dampening force member 200 includes at least one disc spring 204 which can be loaded along its axis either statically or dynamically. By way of example, the at least one disc spring 204 is at least one Belleville washer. The at least one disc spring 204 is housed in a housing 210 mounted to the base 202 of the frame 106. An upper stop member 212, which can form part of the housing 210 mounted to the base 202, is located above the at least one disc spring 204 for engagement therewith. The at least one disc spring 204 receives a plunger 216 having a lower stop member 218 secured thereto. With this arrangement, the at least one disc spring 204 is sandwiched between the upper and lower stop members 212, 218. A lowermost end 220 of the plunger 216 is in engagement with the second end portion 166 of the lever 162. According to another aspect, as shown in FIG. 5, the dampening force member 200 includes a gas spring 226 (for example, a nitrogen gas spring). As is well known, the gas spring 226 uses compressed gas contained within an enclosed cylinder sealed by a sliding piston to pneumatically store potential energy and withstand external force applied parallel to the direction of the piston shaft. The gas spring 226 is housed in the housing 210 and the plunger 216 is configured to be directly engaged by the gas spring 226.

Figure 6A:
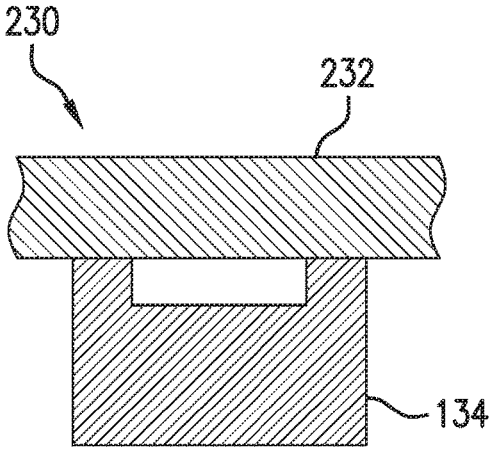
FIG.6A (Prior Art)
FIGS. 6(A)-6(D) schematically depict a known fastening process.
Figure 6B:
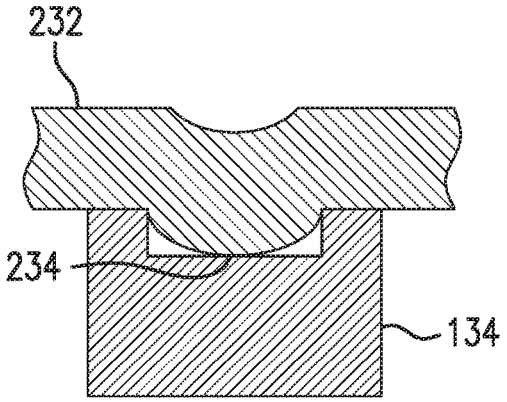
FIG.6B (Prior Art)
Figure 6C:
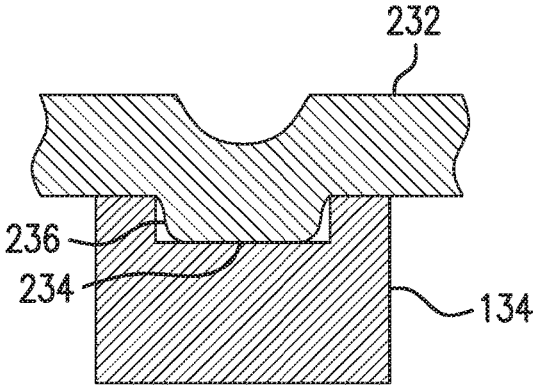
FIG.6C (Prior Art)
Figure 6D:
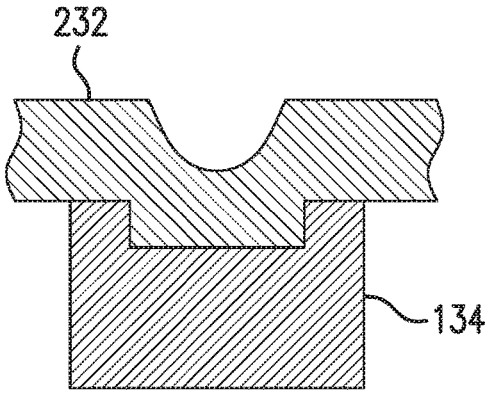
FIG.6D (Prior Art)

FIGS. 6(A)-6(D) schematically depict a known fastening process with the punch, first sheet of the workpiece 230 and rivet removed for clarity. The fastening process starts with the workpiece 230 clamped between a blankholder for the riveting punch and the lower die member 134. The rivet is driven into the workpiece 230 by the punch. Under the force of the punch, the rivet is punched through the workpiece 230, which at the same time deforms in the manner shown filling the cavity of die member 134 (FIGS. 6(B) and 6(C)). In the condition of FIG. 6(C), a stress at a center bottom 234 of the deformed material is low; however a higher stress is located on surface 236 of the deformed material near the unfilled corners of the die member cavity. In the condition of FIG. 6(D), the stress is maximized at the corners of the die member cavity, and for a second sheet formed of a cast material, the high concentrated stress on the second sheet 232 during fastening can result in the second sheet cracking.

Figure 8:
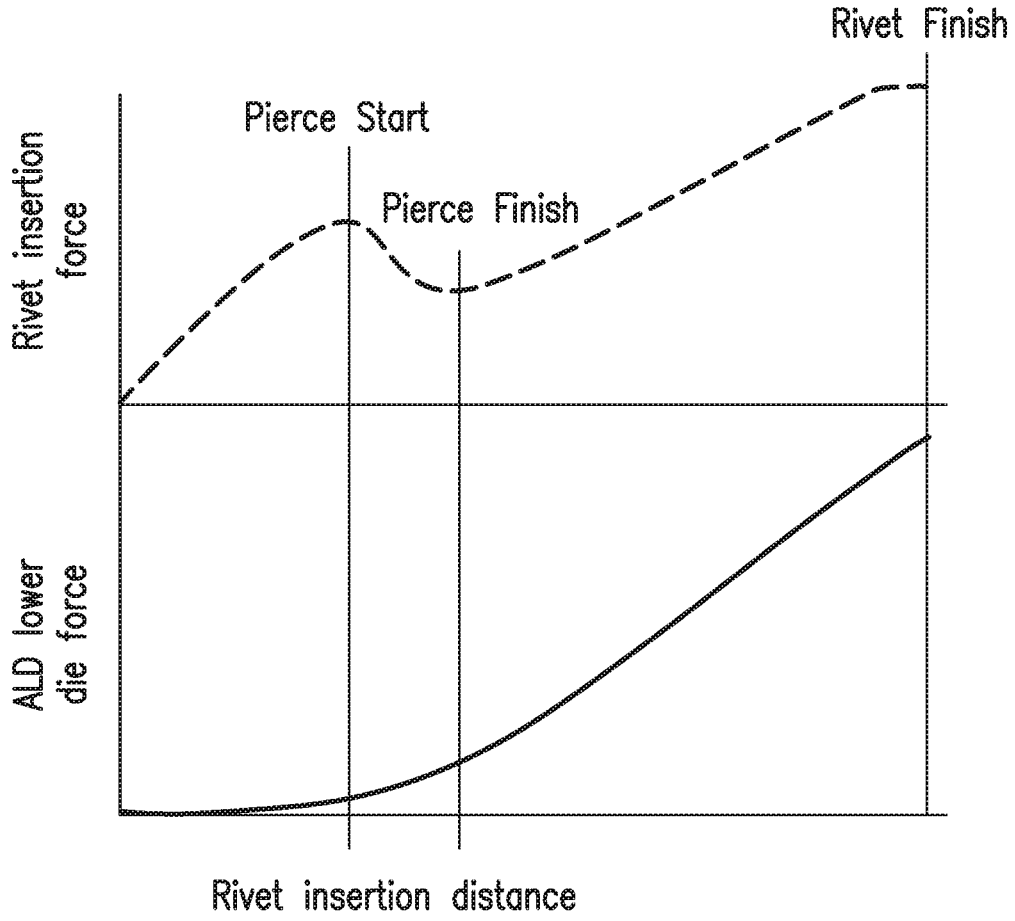

To avoid the defect described above, as depicted in FIGS. 7(A) and (7B), the workpiece 230 is clamped between a blankholder for the riveting punch 240 and the housing 130. The rivet is driven into the workpiece 230 by the punch 240. Under the force of the punch, the rivet is punched through the workpiece 230. As described above, the lever 162 of the stop member 160 has the first end portion 164 in engagement with the rod 136 and the second end portion 166 in engagement with the dampening force member 200. Because an initial dampening force generated from the dampening force member 200 is less than a fastener insertion force generated by the punch 240 (see FIG. 8), the fastener insertion force axially displaces the die member 134 and rod 136 within the bore 132 of the housing. The lever 162 of the stop member 160, in constant contact with the rod 136 and the dampening force member 200, is configured to apply an increasing dampening force generated from the dampening force member 200 to the rod 136 over an entirety of the fastening of the workpiece. This provides for a controlled penetration of the fastener into the workpiece throughout the fastening process. More particularly, the stop member 160 is configured to dampen the axial displacement of the die member 134 and rod 136 within the bore 132 and reduce or decrease the fastener insertion force over a predetermined fastener insertion distance of the fastener into the workpiece 230 (see FIG. 8). As graphically depicted in FIG. 8, the predetermined fastener insertion distance is a distance from an initial piercing of the first sheet 244 by the self-piercing rivet to rivet completion (i.e., rivet finish) of the workpiece 230, and the dampening force generated from the dampening force member 200 continuously increases over the predetermined fastener insertion distance. It should also be appreciated that depending on the type of workpiece, the rivet insertion force can decrease from initial piercing to pierce finish or piercing completion, which is about a halfway point through the fastening process. Further, with the use of the preset or preloaded dampening force member 200 complex controls for the upsetting die assembly 108 are not required, which allows for a high degree of flexibility of the fastening apparatus 100. The force exerted by the dampening force member 200 works naturally with the material of the workpiece to improve flare of the rivet legs during the fastening process.

Figure 9D:
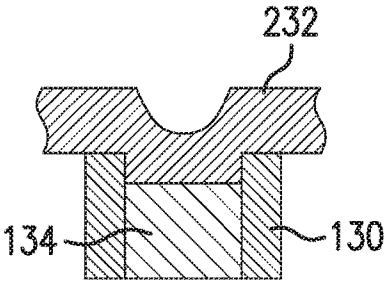
FIGS. 9(A)-9(D) further schematically depict the exemplary fastening process.
Figure 9C:
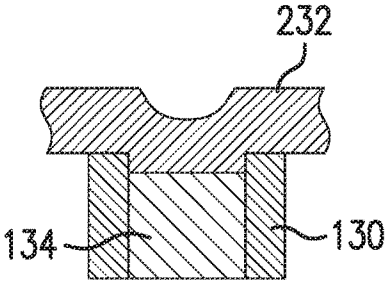
Figure 9B:
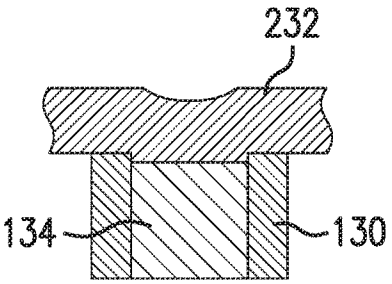
Figure 9A:
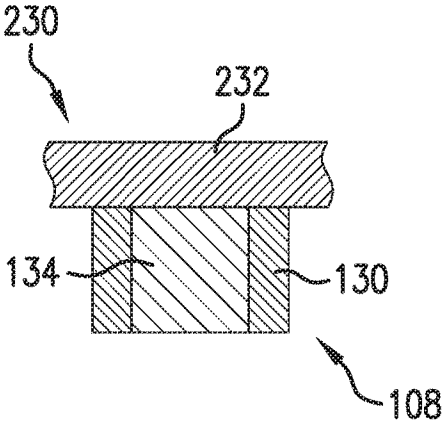

FIGS. 9(A)-9(D) schematically depict a fastening process according to the present disclosure. Again, the fastening process starts with the workpiece 230 clamped between a blankholder for the riveting punch and the upsetting die assembly 108. The rivet is driven into the workpiece 230 by the punch. Under the force of the punch, the rivet is punched through the workpiece 230, which at the same time deforms in the manner shown filling the cavity of die member 134 (FIGS. 9(B) and 9(C)). In the condition of FIG. 9(B), because of the controlled axial displacement of the die member 134 with the housing 130, the second sheet 232 has fairly uniform stress during initial fill of the die member cavity. In the condition of FIG. 9(C), the second sheet 232 maintains uniform stress and material flow to allow for the upsetting of the rivet. In the condition of FIG. 9(D), there is no localized stress at the corners of the die member cavity to induce cracking of the second sheet 232 formed of a cast material.

Accordingly, a fastening method of the present disclosure comprises using a punch 240 to push a fastener into a workpiece 230 having a first and a second sheet 244, 232 of material to be joined; using an upsetting die assembly 108 to upset the fastener, wherein the upsetting die assembly 108 includes a housing 130 defining an axial bore 132, and a die member 134 and a rod 136 located in the bore, wherein the die member and rod are axially displaceable within the bore, and a fastener insertion force generated by the punch 240 displaces the die member 134 and rod 136 within the bore 132; and using a dampening force member 200 preset with a predetermined dampening force to dampen the axial displacement as the fastener penetrates into the workpiece 230.

The exemplary fastening method further includes using a lever 162 to interconnect the upsetting die assembly 108 and the dampening force member 200, the lever applying the dampening force to the rod. The exemplary fastening method further includes mounting the lever 162 beneath the upsetting die assembly 108. And exemplary fastening method further includes continuously decreasing the fastener insertion force over a predetermined fastener insertion distance which is a distance from an initial piercing to piercing completion of the workpiece by the self-piercing rivet.

It should be appreciated that an implementation of the fastening apparatus 100 may be in an automated production line for vehicle bodies where a plurality of robot manipulated systems are used to insert fasteners into workpieces via the fastening apparatuses.

Although embodiments of the invention have been described in the context of rivet insertion, the invention may be used with fasteners other than rivets. In this context the term "fastener" may include rivets (including self-piercing rivets), screws, slugs, weld studs, mechanical studs and other types of fastening devices. Further, the term "workpiece" described herein may include any combination of materials and material types, including adhesive, that are to be fastened whether part of the same structure or separate structures.

It will be appreciated that the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A fastening apparatus for setting a fastener penetrating into a workpiece having a first sheet of material and a second sheet of material to be joined, the fastening apparatus comprising:

a frame supporting a punch and an upsetting die assembly, wherein the upsetting die assembly includes a housing defining an axial bore, and a die member and a rod located in the bore, the rod provided with an upper end portion adapted to mount the die member wherein the die member and rod are axially displaceable within the bore; and a stop member in the form of a lever pivotally connected to the frame beneath the upsetting die assembly and in engagement with a lower end portion of the rod, wherein a fastener insertion force generated by the punch displaces the die member and rod within the bore, and the stop member is configured to dampen the axial displacement and reduce the fastener insertion force over a predetermined fastener insertion distance of the fastener into the workpiece.

2. The fastening apparatus of claim 1, wherein the stop member is in constant contact with the rod and is configured to apply an increasing dampening force to the rod over an entirety of the fastening of the workpiece.

3. The fastening apparatus of claim 2, wherein the dampening force is generated from a dampening force member operably coupled to the stop member.

4. The fastening apparatus of claim 3, wherein the dampening force member includes a gas spring.

5. The fastening apparatus of claim 3, wherein the dampening force member includes at least one disc spring.

6. The fastening apparatus of claim 3, wherein the frame is generally C-shaped including a base and a pair of arms extending from the base, and further including a housing mounted to the frame base, the housing adapted to house the dampening force member.

7. The fastening apparatus of claim 3, wherein the stop member is configured with its fulcrum located between the upsetting die assembly and the dampening force member, wherein a first end portion of the lever is in engagement with the lower end portion of the rod and a second end portion of the lever is in engagement with the dampening force member.

8. The fastening apparatus of claim 7, wherein the frame includes a channel for receiving the lever.

9. The fastening apparatus of claim 3, wherein the dampening force member is preset with a predetermined dampening force to be applied to the stop member regardless of fastener type and material of the first and second sheets.

10. The fastening apparatus of claim 1, wherein the frame is generally C-shaped including a base and a pair of arms extending from the base, wherein the stop member is located beneath a lower one of the arms and extends along a length direction of that lower arm, and the lower end portion of the rod extends outwardly from the upsetting die housing for engagement with the stop member.

11. The fastening apparatus of claim 1, wherein the fastener is a self-piercing rivet and the predetermined fastener insertion distance is a distance from an initial piercing to rivet completion of the workpiece by the self-piercing rivet.

12. A fastening apparatus for setting a self-piercing rivet penetrating into a workpiece having a first sheet of material and a second sheet of material to be joined, the fastening apparatus comprising:

a frame supporting a punch and an upsetting die assembly, wherein the upsetting die assembly includes a housing defining an axial bore, and a die member and a rod located in the bore, an upper end portion of the rod adapted to mount the die member and a lower end portion of the rod projecting from a lower end of the housing, wherein the die member and rod are axially displaceable within the bore;

a dampening force member mounted to the frame; and a stop member pivotally connected to the frame beneath the upsetting die assembly and interconnecting the upsetting die assembly and the dampening force member, the stop member is in the form of a lever having a first end portion in engagement with the lower end portion of the rod and a second end portion in engagement with the dampening force member, wherein a fastener insertion force generated by the punch displaces the die member and rod within the bore, and the stop member is configured to apply a dampening force generated from the dampening force member to the lower end portion of the rod to dampen the axial displacement and decrease the fastener insertion force over a predetermined fastener insertion distance which is a distance from an initial piercing to rivet completion of the workpiece by the self-piercing rivet.

13. The fastening apparatus of claim 12, wherein the dampening force member is preset with a predetermined dampening force.

14. The fastening apparatus of claim 12, wherein the dampening force member includes a gas spring.

15. The fastening apparatus of claim 12, wherein the dampening force member includes at least one disc spring.

* * * * *